US005438927A

United States Patent [19]

Banike et al.

[11] Patent Number: 5,438,927

[45] Date of Patent: Aug. 8, 1995

[54] INK FOUNTAIN ASSEMBLY

[75] Inventors: Ronald A. Banike, Orland Park; Robert F. Bohanek, Clarendon Hills, both of Ill.

[73] Assignee: R. R. Donnelley & Sons Company, Chicago, Ill.

[21] Appl. No.: 208,353

[22] Filed: Mar. 9, 1994

[51] Int. Cl.[6] ..... B41F 31/05; B41F 31/06

[52] U.S. Cl. ..... 101/365

[58] Field of Search ..... 101/365, 366, 350, 207–210, 101/DIG. 47, DIG. 45, 363, 157, 169; 118/261

[56] References Cited

U.S. PATENT DOCUMENTS

| | | | |
|---|---|---|---|
| 3,559,573 | 2/1971 | Hantscho | 101/365 |
| 3,921,525 | 11/1975 | D'Amato et al. | 101/365 |
| 4,393,776 | 7/1983 | Toyoda | 101/365 |
| 4,587,899 | 5/1986 | Theilacker | 101/365 |
| 4,624,183 | 11/1986 | Kunkel et al. | 101/365 |
| 4,655,133 | 4/1987 | O'Dea et al. | 101/365 |
| 4,711,175 | 12/1987 | Hummel et al. | 101/365 |
| 4,969,395 | 11/1990 | Mitamura et al. | 101/365 |
| 5,150,649 | 9/1992 | Kumaki et al. | 101/365 |
| 5,165,336 | 11/1992 | Spencer | 101/35 |

FOREIGN PATENT DOCUMENTS

| | | | |
|---|---|---|---|
| 182291 | 5/1986 | European Pat. Off. | 101/DIG. 47 |
| 477389 | 4/1992 | European Pat. Off. | 101/365 |

*Primary Examiner*—J. Reed Fisher

*Attorney, Agent, or Firm*—Marshall, O'Toole, Gerstein, Murray & Borun

[57] ABSTRACT

In order to improve the operation of an ink fountain, particularly for web offset printing presses, an ink fountain assembly is disclosed which includes a fountain roller and a fountain blade assembly which is positioned in operatively associated relation to the fountain roller. The fountain blade assembly has a fountain base with a key supporting surface and aim has a plurality of ink keys on the key supporting surface of the fountain base to extend substantially along the length of the fountain roller in variably spaced confronting parallel relation to the fountain roller. With these features of construction, the ink fountain assembly includes an alignment system for maintaining each of the ink keys in parallel relation to the fountain roller and a drive system for controlled movement of each of the ink keys toward and away from the fountain roller.

13 Claims, 2 Drawing Sheets

INK FOUNTAIN ASSEMBLY

FIELD OF THE INVENTION

The present invention is generally directed to equipment designed for utilization in printing presses, and, more particularly, an ink fountain assembly with moveable keys always aligned with a fountain roller.

BACKGROUND OF THE INVENTION

In recent years, there has been a growing awareness of various problems that are particularly inherent in the operation of printing presses. It is known, for example, that ink keys in an ink fountain are more often than not out of square to the fountain roller and/or otherwise fail to meet the desired specifications. As such, uniform ink film thickness across the fountain roller is impossible to set, and color matching is difficult, if not impossible, to successfully achieve.

In one practical example, it was found from actual measurements that ink keys on a conventional fountain assembly were out of square by an average of 0.009". This quite simply means that, for an ink key that is approximately 1.5" in width, one end of the key is 0.009" out of square to the other end. As will be recognized by the skilled artisan, a 0.009" out of square measurement will not allow proper ink adjustment in the zone of that ink key on the ink fountain assembly.

To solve this problem, it has been proposed that a steel key be positioned permanently in the center of the fountain. The thinking behind this proposal is to minimize the effect of accumulative errors across a typical fountain of 24 keys inasmuch as only 12 keys on each side of the fountain center can be skewed, thereby reducing the error in half. Although this concept is an improvement on original fountain designs, it simply does not prevent the keys from being undesirably skewed.

In addition to the foregoing, there is a problem in connection with the adjustment of the keys in relation to the fountain roller. More specifically, it is known from testing that ink key movement does not correlate with the LED lights at the press console, but, rather, the LED lights move when the typical potentiometer driven by the ink key motor moves, which is not an indication of actual key movement. During actual testing, it was found that delays as long as four (4) seconds were encountered from the time the switch for key movement was depressed by the pressman at the press console until the key actually moved at the fountain assembly. As a result, the pressman is at a total disadvantage, particularly since it is impossible to know in which direction the key last moved.

In this connection, when a key is moved in the same direction, it has been typical for the dead time to be from one (1) to two (2) seconds maximum. On the other hand, when the key reverses direction, that time can be as long as three (3) to four (4) seconds before the ink key actually moves. As will be appreciated, this makes it very difficult for the pressman to make precise four color moves without knowing when the key is actually moving.

From the foregoing, it would be highly desirable to sense actual ink key movements more accurately at the console, using the conventional LED's on the press console of the printing press. There are typically 50 LED's represented in the closed to fully opened position, with each light representing 2% of movement.

Unquestionably, it would be beneficial to know when actual key movements occur so that precise color moves can be accomplished in the shortest period of time to reduce makeready and run waste.

The present invention is directed to overcoming one or more of the foregoing problems and achieving one or more of the resulting objects.

SUMMARY OF THE INVENTION

It is therefore a principal object of the present invention to provide an improved ink fountain assembly having a unique alignment capability for maintaining the ink keys in parallel to the fountain roller. It is a further object of the present invention to provide a unique drive system for an ink fountain assembly for accurately controlled movement of the ink keys toward and away from the fountain roller. It is also an object of the present invention to provide an ink fountain assembly which is adapted to monitor and control a sensor and drive from a press console particularly in web offset printing.

Accordingly, the present invention is directed to an ink fountain assembly having a fountain roller and a fountain blade assembly which is suitably positioned so as to be in operatively associated relation to the fountain roller. The fountain blade assembly includes a fountain base having a key supporting surface for a plurality of ink keys. The key supporting surface is such that the ink keys extend substantially along the length of the fountain roller. The ink keys each are adapted to be disposed in variably spaced confronting parallel relation to the fountain roller. Still additionally, the ink fountain assembly includes alignment means for maintaining each of the ink keys in parallel relation to the fountain roller and drive means for controlled movement of each of the ink keys toward and away from the fountain roller.

In the exemplary embodiment, the alignment means serves to accurately maintain each of the ink keys in parallel relation to the fountain roller by utilizing means operative between the fountain base and each of the ink keys. Further, the drive means advantageously includes an actuator operatively interconnected to each of the ink keys on a side opposite a roller confronting surface thereof. As for the roller confronting surface of the ink keys, they preferably have a blade edge adapted to be variably spaced from the fountain roller by the drive means to control thickness of an ink film to be transferred from the fountain roller.

With these features, the blade edges are advantageously maintained parallel to the fountain roller by the means operative between the fountain base and ink keys which suitably includes a pair of pins in each of the ink keys disposed in a corresponding slot in the fountain base. Still additionally, the means for sensing the instantaneous position of the ink keys advantageously includes a target associated with each of the ink keys and a sensor which is positioned in proximity thereto to thereby suitably control spacing relative to the fountain roller.

In a highly preferred embodiment, the key supporting surface is planar and the ink keys each are generally rectangular having parallel top and bottom surfaces, parallel side surfaces, and a rear surface parallel to the roller confronting surface having the blade edge. Each of the ink keys preferably has a pair of pin-receiving bores lying in a plane intermediate and parallel to the side surfaces and perpendicular to the blade edge and extending from the top surface completely through the bottom surface of the ink key. Moreover, the pins advantageously are inserted to normally project from the bottom surface of the ink keys but can be repositioned to project from the top surface to accommodate inverting the ink keys for continued use after the bottom surface has become worn.

Additional details of the present invention include each of the actuators having an extendable and retractable arm connected to a pin disposed in a hole in the corresponding one of the ink keys in the plane of the pin-receiving bores generally adjacent the rear surface thereof. It is also contemplated that each of the sensors may advantageously include an eddy current probe mounted in a fixed position on the fountain base to generate a magnetic field between a tip of the probe and the target, which is indicative of the instantaneous distance therebetween. Still additional details include each of the ink keys having a hole on opposites sides of the rear surface thereof, with the target being formed of alloy steel so as to be releasably secured to the rear surface thereof using either of the holes to further accommodate inverting the ink key.

Other objects, advantages and features of the present invention will become apparent from a consideration of the following specification taken in conjunction with the accompanying drawings.

DETAILED DESCRIPTION OF THE PREFERRED EMBODIMENT

Figure 1:
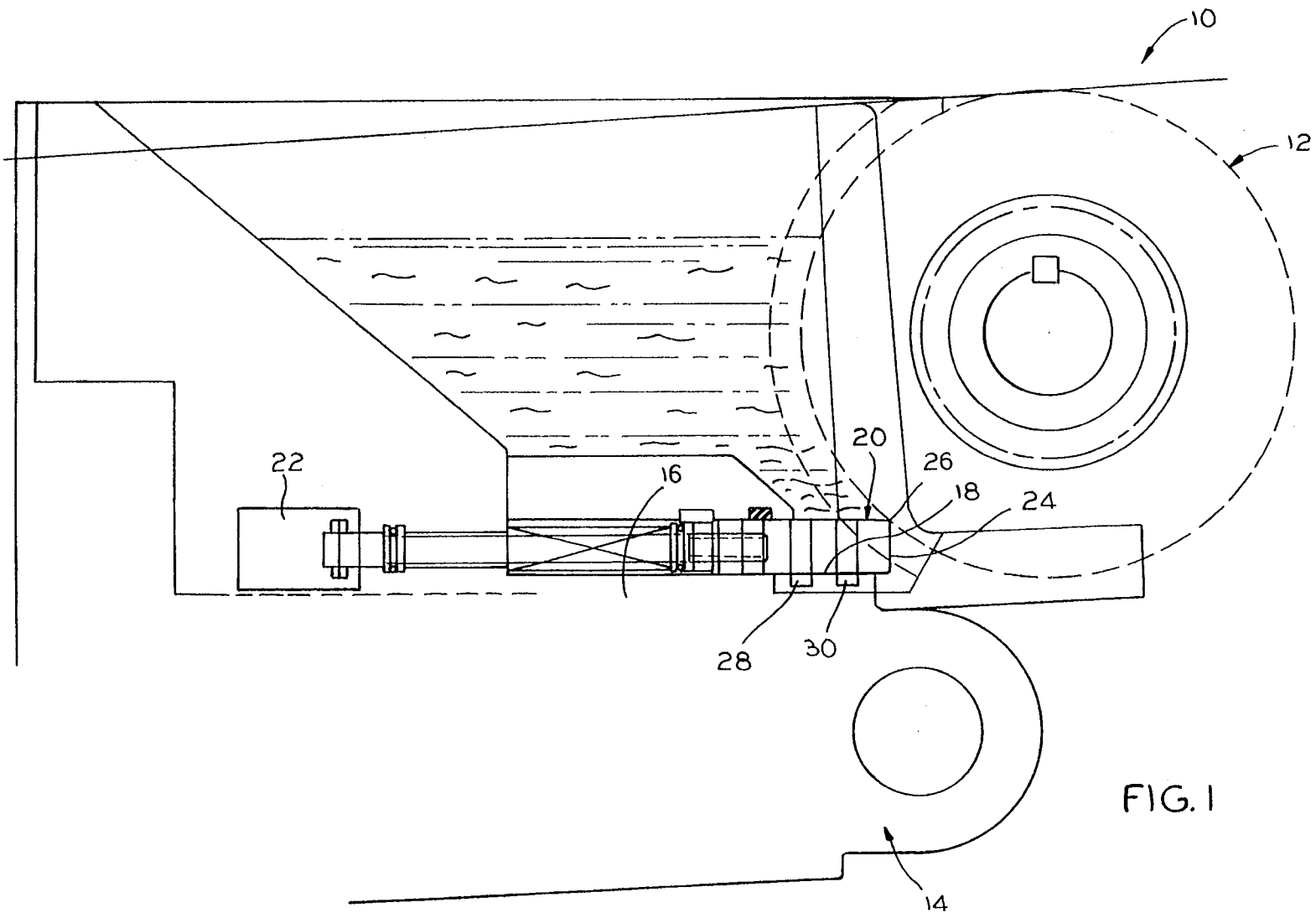
FIG. 1 is an end elevational view of an ink fountain assembly in accordance with the present invention.

In the illustrations given, and with reference first to FIG. 1, the reference numeral 10 will be understood to designate generally an ink fountain assembly in accordance with the present invention which includes a fountain roller 12 and a fountain blade assembly generally designated 14. The fountain blade assembly 14 is positioned in operatively associated relation to the fountain roller 12 and includes a fountain base 16 having a key supporting surface 18 (see also FIG. 3). It also includes a plurality of ink keys 20 on the key supporting surface 18 of the fountain base 16 which extend substantially along the length of the fountain roller 12. The ink fountain assembly 10 is operable such that the ink keys 20 are each side-by-side and adapted to be disposed in variably spaced but confronting parallel relation to the fountain roller 12. With these features of construction, the ink fountain assembly 10 also includes alignment means for accurately maintaining each of the ink keys 20 in parallel relation to the fountain roller 12 and drive means for controlled movement of each of the ink keys 20 toward and away from the fountain roller 12.

More specifically, the alignment means advantageously includes means operative between the fountain base 16 and each of the ink keys 20 for maintaining the ink keys 20 in parallel relation to the fountain roller 12. For this purpose, the drive means includes an actuator 22 operatively interconnected to each of the ink keys 20 on a side opposite a roller confronting surface 24 thereof. The roller confronting surface 24 of each of the ink keys 20 will have a blade edge 26 which is specifically adapted to be variably spaced from the fountain roller 12 in order to control the thickness of an ink film which is to be transferred from the fountain roller 12. In this connection, the blade edges 26 will be understood to be maintained parallel to the fountain roller 12 by the means operative between the fountain base 16 and ink keys 20. In the illustrated embodiment, the alignment means which is operative between the fountain base 16 and ink keys 20 includes a pair of pins 28 and 30 in each of the ink keys 20 disposed in a corresponding slot 30 in the fountain base 16 (see also FIG. 2).

Figure 2:
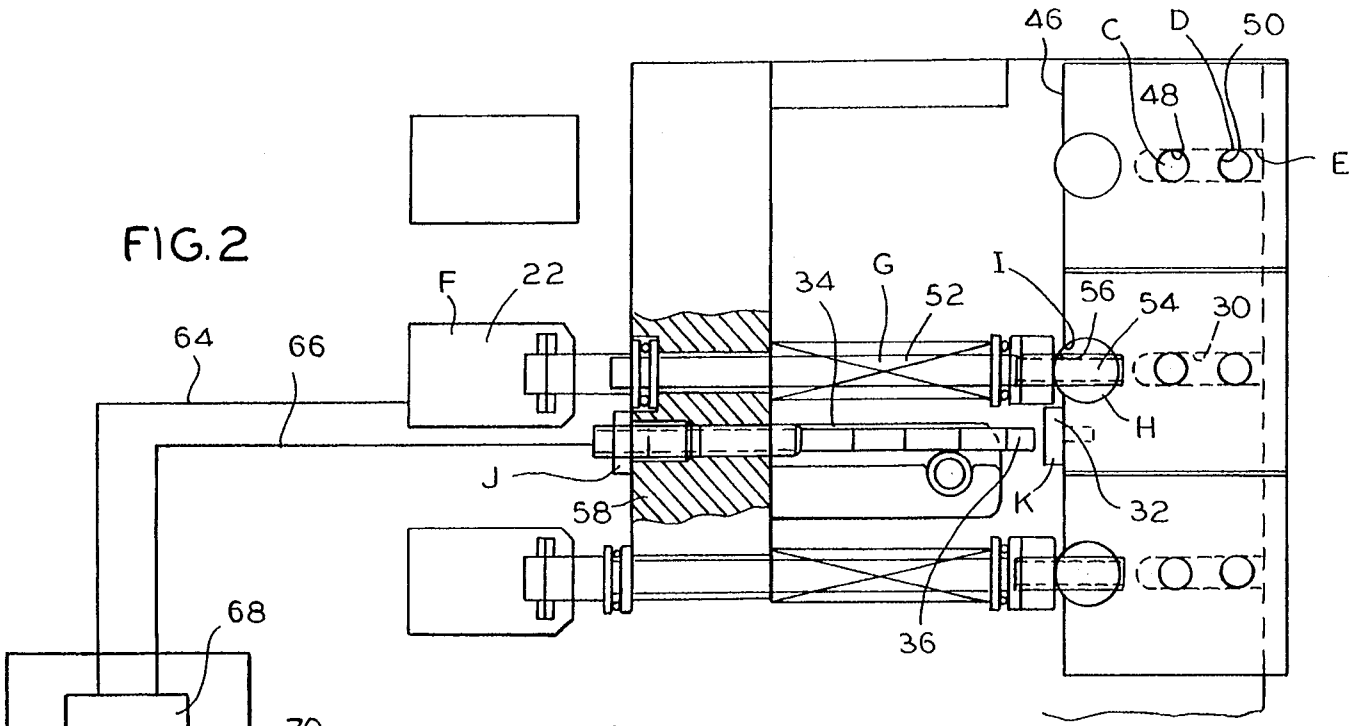
FIG. 2 is a partial top plan view of the fountain blade assembly as illustrated in FIG. 1.

Still referring to FIG. 2, the ink fountain assembly 10 will be seen to include means for sensing the instantaneous position of each of the ink keys 20 to control spacing relative to the fountain roller 12 which comprises a target 32 associated with each of the ink keys 20 and a sensor 34 that is positioned in proximity thereto. In the embodiment as illustrated in FIG. 2, the sensors 34 each comprise an eddy current probe which is mounted in a fixed position on the fountain base 16 so as to generate a magnetic field indicative of the instantaneous distance between a tip 36 and the target 32 which is on the corresponding one of the ink keys 20.

Figure 3:
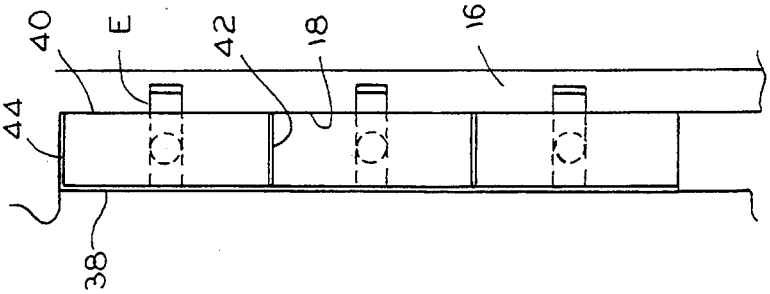
FIG. 3 is a partial end elevational view of the fountain blade assembly as illustrated in FIG. 2.
Figure 4:
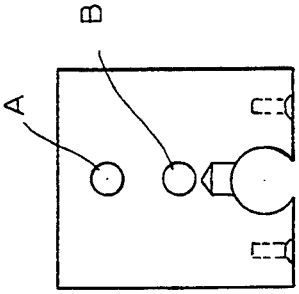
FIG. 4 is a top plan view of an ink key for the fountain blade assembly as illustrated in FIG. 2.

As will be appreciated from FIG. 3, the key supporting surface 18 is planar, and the ink keys 20 each are generally rectangular having parallel top and bottom surfaces 38 and 40, parallel side surfaces 42 and 44, and a rear surface 46 parallel to the roller confronting surface 24 having the blade edge 26. Each of the ink keys 20 has a pair of pin-receiving bores 48 and 50 (see also FIG. 4) which lie in a plane intermediate and parallel to the side surfaces 42 and 44 and perpendicular to the blade edge 26, and the bores 48 and 50 extend from the top surface 38 completely through the bottom surface 40 of the ink key 20. With this arrangement, it can be appreciated that the pins 28 and 30 normally project from the bottom surface 40 of each of the ink keys 20 but can be repositioned to project from the top surface 38 to accommodate inverting each of the ink keys 20 for continued use after the bottom surface 40 has become worn.

Figure 5:
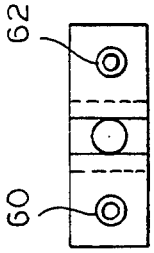
FIG. 5 is a rear elevational view of the ink key as illustrated in FIG. 4.

Referring specifically to FIG. 2, it will be seen that each of the actuators 22 has an extendable and retractable arm 52 which is connected to a pin 54 disposed in a hole 56 formed in the corresponding one of the ink keys 20 in the plane of the pin-receiving bores 48 and 50 at a point which is generally adjacent the rear surface 46 thereof. It will also be appreciated from FIG. 2 that the sensors 34 each advantageously comprise an eddy current probe mounted in a fixed position by means of an upstanding support 58 which extends upwardly from the fountain base 16 such that the probes can generate a magnetic field between the tip 36 and the target 32 as previously discussed. Still additionally, and referring to FIGS. 4 and 5, it will be seen that the ink keys 20 each have a hole 60 and 62 on opposite sides of the rear surface 46 thereof and the target 32, which is preferably formed of alloy steel, is releasably secured to the rear surface 46 thereof using either of the holes 60 and 62 to further accommodate inverting the ink key 20.

Still referring to FIG. 2, the ink fountain assembly 10 preferably includes suitable means for monitoring and controlling each of the actuators 22 and sensors 34. This preferably takes the form of cables, such as 64 and 66, which extend from the actuators 22 and sensors 34 to a conventional control panel 68 located in a conventional press console 70 for a web offset printing press. In this manner, a pressman can move the blade edges 26 to selected positions in relation to the fountain roller 12 in order to accurately control the thickness of the ink film thereon.

With the design of the components of the ink fountain assembly 10, it is possible to fully achieve the objectives of the present invention. This follows from the fact that the forming of the keys to accurate dimensions, and the placement and sizing of the various bores and pins in the keys can be accomplished to very close tolerances, as can the forming of the grooves for the pins in the fountain base. In actual testing, it has been determined that the movement of the inventive ink keys requires 20% less torque than for conventional key assemblies.

Moreover, using laser instruments, ink film measurements have been taken on the inventive assembly for purposes of comparison with a commercially available fountain. Due in large part to skewing of ink keys on the commercially available fountain, which does not occur with the inventive ink fountain assembly, the commercially available fountain could not produce a uniform ink film thickness using GPI 4 color cover inks. In contrast, the inventive ink fountain, which does not have skewed ink keys, produced a uniform ink film thickness across the fountain roller for all GPI 4 color cover inks.

In an actual embodiment, the ink keys were made of Delrin 150 and were modified to include two $\frac{1}{4}''$ diameter Delrin 150 pins. It was determined that the ink keys could not be skewed or moved out of squareness to the fountain roller with the Delrin 150 pins disposed in the slots machined in the fountain base. In the embodiment of the invention, the ink keys were moveable toward and away from the fountain roller by a distance of 0.026".

In the inventive ink fountain, thermal expansion and a temperature rise from 74° F. to 100° F. resulted in a 0.0004" interference to a 0.0055" clearance between the sides of the ink keys. At a normal operating temperature of 85° F., a 0.002" to 0.003" clearance exists between the sides of adjacent ones of the ink keys that facilitates movement while at the same time avoiding leakage.

As a result, the inventive ink fountain does not leak and the ink keys simply do not touch side to side in normal operation and, therefore, should last indefinitely. As previously mentioned, the two Delrin 150 pins can be pushed through the ink key and the ink key inverted for use in the event of wear on the bottom surface.

In addition to the foregoing advantages, the ink keys are all identical. Thus, they are interchangeable with each other. As a result, the invention has eliminated any selective fitting.

As for the eddy current probe, it has been determined that a 200 MV per mill probe is suitable. This type of probe requires a proximitor to drive it and, in addition, proximitor cables and a main power supply of 18–24 volts. As will be appreciated, these are basic elements required in any proximity probe system.

In actual testing, the sensitivity of the probe has been checked throughout the range of ink key movement, i.e., 0.026". The amount of movement vs. the voltage output from the eddy current probe has been determined to be very accurate, and, thus, by connecting the eddy current probe into the LED lights at a typical press console, the present invention makes it possible not only to determine precisely when ink key movement is occurring but also the amount of ink key movement since the prior move. Because of this capability, it is now possible to permit setting of color precisely and accurately on every attempt.

While in the foregoing there has been set forth a preferred embodiment of the invention, it will be appreciated that the details herein given may be varied by those skilled in the art without departing from the true spirit and scope of the appended claims.

What is claimed is:

1. An ink fountain assembly, comprising:

a fountain roller and a fountain blade assembly positioned in operatively associated relation to said fountain roller, said fountain blade assembly including a fountain base having a key supporting surface and also including a plurality of ink keys on said key supporting surface of said fountain base to extend substantially along the length of said fountain roller, said ink keys each being adapted to be disposed in variably spaced confronting parallel relation to said fountain roller;

alignment means for accurately maintaining each of said ink keys in parallel relation to said fountain roller including means operative between said fountain base and each of said ink keys; and drive means for controlled movement of each of said ink keys toward and away from said fountain roller including an actuator operatively interconnected to each of said ink keys on a side opposite a roller confronting surface thereof;

said roller confronting surface of each of said ink keys having a blade edge adapted to be variably spaced from said fountain roller by said drive means to control thickness of an ink film to be transferred from said fountain roller;

each of said ink keys having parallel side surfaces and a pair of pin-receiving bores lying in a plane intermediate and parallel to said parallel side surfaces and perpendicular to said blade edge, said means operative between said fountain base and each of said ink key including a pin in each of said pin-receiving bores in each of said ink keys disposed in a single corresponding slot in said fountain base for each of said ink keys, each of said slots in said fountain base also lying in a plane perpendicular to said blade edge of the corresponding one of said ink keys whereby said blade edge of each of said ink keys is maintained parallel to said fountain roller.

2. The fountain assembly of claim 1 including means for controlling said drive means from a remote location to move said blade edges relative to said fountain roller.

3. The fountain assembly of claim 2 wherein said controlling means includes a control panel located in a press console for operating a web offset printing press.

4. The fountain assembly of claim 1 including means for sensing the instantaneous position of each of said ink keys to control spacing relative to said fountain roller.

5. The fountain assembly of claim 4 wherein said sensing means includes a target associated with each of said ink keys and a sensor positioned in proximity thereto.

6. An ink fountain assembly, comprising:

a fountain roller and a fountain blade assembly positioned in operatively associated relation to said fountain roller, said fountain blade assembly including a fountain base having a key supporting surface and also including a plurality of ink keys on said key supporting surface of said fountain base to extend substantially along the length of said fountain roller, said ink keys each being adapted to be disposed in variably spaced confronting parallel relation to said fountain roller;

alignment means for accurately maintaining each of said ink keys in parallel relation to said fountain roller including means operative between said fountain base and each of said ink keys;

drive means for controlled movement of each of said ink keys toward and away from said fountain roller including an actuator operatively interconnected to each of said ink keys on a side opposite a roller confronting stirface thereof;

said roller confronting surface of each of said ink keys having a blade edge adapted to be variably spaced from said fountain roller by said drive means to control thickness of an ink film to be transferred from said fountain roller;

said blade edges being maintained parallel to said fountain roller by said means operative between said fountain base and ink keys including a pair of pins in each of said ink keys disposed in a corresponding slot in said fountain base;

each of said ink keys having parallel side surfaces and a pair of pin-receiving bores lying in a plane intermediate and parallel to said side surfaces and perpendicular to said blade edge, one of said pair of pins in each of said ink keys being disposed in each of said pin-receiving bores thereof, each of said slots in said fountain base also lying in a plane intermediate and parallel to said parallel side surfaces and perpendicular to said blade edge of the corresponding one of said ink keys; and means for sensing the instantaneous position of each of said ink keys to control spacing relative to said fountain roller including a target associated with each of said ink keys and a sensor positioned in proximity thereto.

7. The fountain assembly of claim 6 including means for monitoring and controlling said sensing means and drive means to move said blade edges to selected positions in relation to said fountain roller comprising a control panel located in a press console for a web offset printing press.

8. The fountain assembly of claim 6 wherein said key supporting surface is planar and said ink keys each are generally rectangular having parallel top and bottom surfaces, and a rear surface parallel to said roller confronting surface having said blade edge.

9. The fountain assembly of claim 8 wherein said pair of pin-receiving bores in each of said ink keys extend from said top surface completely through said bottom stirface of said ink key.

10. The fountain assembly of claim 9 wherein said pins normally project from said bottom surface of each of said ink keys but can be repositioned to project from said top surface to accommodate inverting each of said ink keys for continued use after said bottom surface has become worn.

11. The fountain assembly of claim 9 wherein each of said actuators has an extendable and retractable arm connected to a pin disposed in a hole in the corresponding one of said ink keys in said plane of said pin-receiving bores generally adjacent said rear surface thereof.

12. The fountain assembly of claim 9 wherein each of said sensors includes an eddy current probe mounted in a fixed position on said fountain base to generate a magnetic field between a tip of said eddy current probe and said target indicative of the instantaneous distance therebetween.

13. The fountain assembly of claim 10 wherein each of said ink keys has a hole on opposite sides of said rear surface thereof and said target is formed of alloy steel and is releasably secured to said rear surface thereof using either of said holes to accommodate inverting said ink key.

* * * * *